US006905507B2

(12) United States Patent
Hinshaw

(10) Patent No.: US 6,905,507 B2
(45) Date of Patent: Jun. 14, 2005

(54) TEETHING PACIFIER

(75) Inventor: Susan Hinshaw, Norton Shores, MI (US)

(73) Assignee: Sassy, Inc., Northbrook, IL (US)

( * ) Notice: Subject to any disclaimer, the term of this patent is extended or adjusted under 35 U.S.C. 154(b) by 381 days.

(21) Appl. No.: 10/077,511

(22) Filed: Feb. 15, 2002

(65) Prior Publication Data

US 2002/0077663 A1 Jun. 20, 2002

Related U.S. Application Data

(63) Continuation-in-part of application No. 09/620,501, filed on Jul. 20, 2000, now Pat. No. 6,447,536.

(51) Int. Cl.[7] ..... A61J 17/00
(52) U.S. Cl. ..... 606/235
(58) Field of Search ..... 606/234–236

(56) References Cited

U.S. PATENT DOCUMENTS

| | | | | |
|---|---|---|---|---|
| 652,034 | A | 6/1900 | Meinecke | |
| 1,070,430 | A | 8/1913 | Dunn | |
| 1,518,823 | A | 12/1924 | Schimdt et al. | |
| 1,913,627 | A | 6/1933 | Epstein | |
| 2,085,704 | A | 6/1937 | Sacks | 128/360 |
| 2,408,735 | A | 10/1946 | Claflin | 128/359 |
| D145,896 | S | 11/1946 | Grosvenor | D34/2 |
| D147,852 | S | 11/1947 | Hyman | D34/4 |
| D150,114 | S | 7/1948 | Davis | D83/1 |
| D170,050 | S | 7/1953 | Colm | D83/1 |
| 2,825,335 | A | 3/1958 | Natonek | 128/360 |
| 2,827,055 | A | 3/1958 | Carden | 128/359 |
| 3,267,937 | A | 8/1966 | Verschoor | 128/360 |
| D219,251 | S | 11/1970 | Chrones | D83/8 |
| 3,556,104 | A | 1/1971 | Janklow | 128/360 |
| 3,653,386 | A | 4/1972 | Jacobus | 128/360 |
| 3,669,117 | A | 6/1972 | Herbst | 128/360 |
| 3,690,324 | A | 9/1972 | Spivack | 128/359 |
| 3,865,115 | A | 2/1975 | De Mieri | 128/359 |
| 3,990,455 | A | 11/1976 | Panicci | 128/359 |
| D249,161 | S | 8/1978 | Rohrig | D24/45 |

(Continued)

OTHER PUBLICATIONS

The First Years, Ideas Inspried by Parents 1994 Catalog, excerpts.
Kids II 1996 Catalog, excerpts.
Early Years International Plaything, Infant Development and Learning Guide, excerpt.

(Continued)

*Primary Examiner*—Julian W. Woo
*Assistant Examiner*—D. Jacob Davis
(74) *Attorney, Agent, or Firm*—Amster, Rothstein & Ebenstein LLP

(57) ABSTRACT

A teething pacifier comprising a pacifier guard having two opposing sides, a nipple extending outwardly from one side of the pacifier guard and a handle associated with the opposite side of the pacifier guard. The handle includes a first teething material and a second teething material having a substantially similar hardness as that of the first teething material. The second teething material is molded over the first teething material to create a varied teething surface on the handle for infant teething thereon. The first teething material may further include an overmold enhancing surface such as a keyway extending around the handle, at least one flat face extending around the handle and/or at least one recess extending around the circumference of the handle at select points on the handle.

24 Claims, 4 Drawing Sheets

U.S. PATENT DOCUMENTS

| | | | | |
|---|---|---|---|---|
| 4,204,362 | A | 5/1980 | Fournier | 46/116 |
| 4,277,910 | A | 7/1981 | Kramer | 46/116 |
| D264,630 | S | 5/1982 | Nakao et al. | D24/45 |
| 4,577,632 | A | 3/1986 | Grasset | 128/360 |
| D285,839 | S | 9/1986 | Roehrig | D24/45 |
| D291,122 | S | 7/1987 | Grubb et al. | D24/45 |
| 4,697,589 | A | 10/1987 | King et al. | 128/359 |
| D294,297 | S | 2/1988 | Roehrig | D24/45 |
| D298,958 | S | 12/1988 | Ulbrich | D21/166 |
| D304,237 | S | 10/1989 | Daykin | D24/45 |
| 4,896,666 | A | 1/1990 | Kinkle | 128/202.13 |
| 4,994,075 | A | 2/1991 | Smith et al. | 606/235 |
| 5,078,732 | A | 1/1992 | Ceniceros | 606/235 |
| 5,150,504 | A | 9/1992 | Cohen | 24/302 |
| 5,160,344 | A | 11/1992 | Werton | 606/235 |
| 5,263,975 | A | 11/1993 | La Rocca | 606/234 |
| 5,284,490 | A | 2/1994 | Green | 606/235 |
| D346,865 | S | 5/1994 | Gregory | D24/196 |
| D349,345 | S | 8/1994 | Abrams | D24/195 |
| 5,334,218 | A | 8/1994 | Johnson | 606/235 |
| 5,342,398 | A | 8/1994 | Sun | 606/235 |
| 5,344,355 | A | 9/1994 | Silverstein | 446/72 |
| D351,471 | S | 10/1994 | Abrams | D24/195 |
| 5,385,573 | A | 1/1995 | Wright | 606/235 |
| 5,391,184 | A | 2/1995 | Rosenthal | 606/236 |
| 5,522,849 | A | 6/1996 | Xiques et al. | 606/236 |
| 5,551,952 | A | 9/1996 | Falgout | 601/139 |
| 5,606,871 | A | 3/1997 | Hansen et al. | 62/457.5 |
| 5,649,964 | A | 7/1997 | Berman et al. | 606/235 |
| 5,653,731 | A | 8/1997 | Rohrig | 606/234 |
| 6,041,950 | A | 3/2000 | Soehnlein | 215/11.1 |
| 6,056,774 | A | 5/2000 | Johansen et al. | 606/234 |

OTHER PUBLICATIONS

Sassy, Inc. Catalog, excerpts.

Sassy, Inc. 1999 Catalog, disclosing various pacifiers and teething devices at pp. 2, 5–12, 15, 20 and 21.

Sassy 2002 Catalog, excerpts.

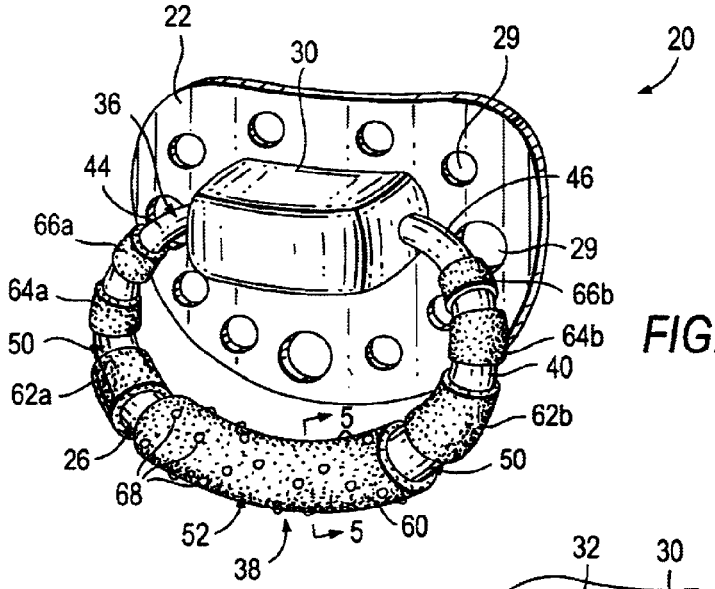
FIG. 1
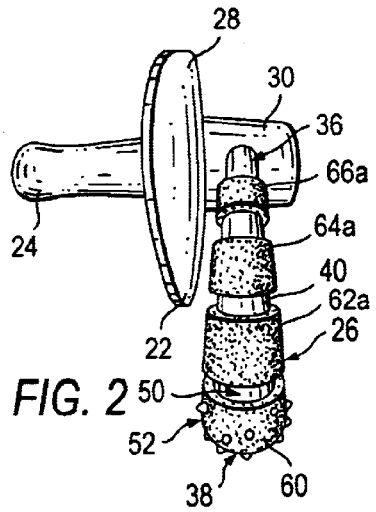
FIG. 2
FIG. 3
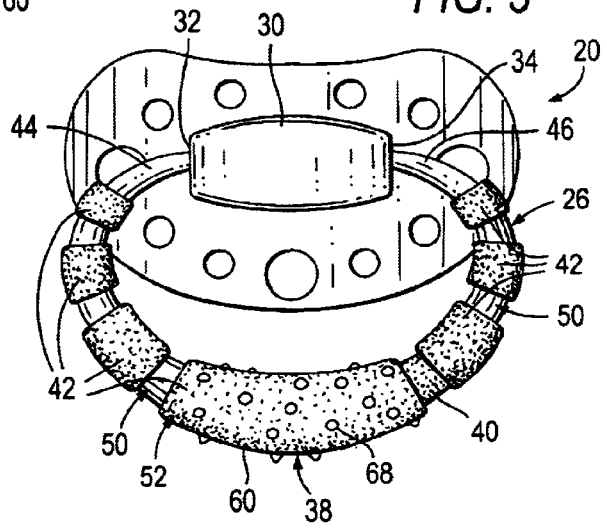
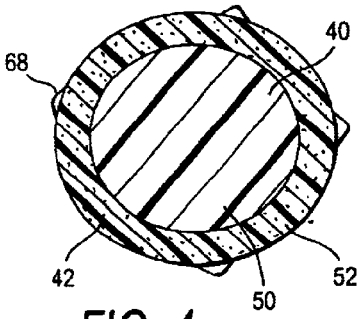
FIG. 4
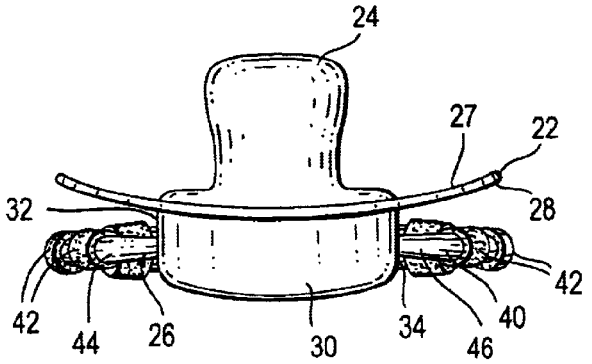
FIG. 5

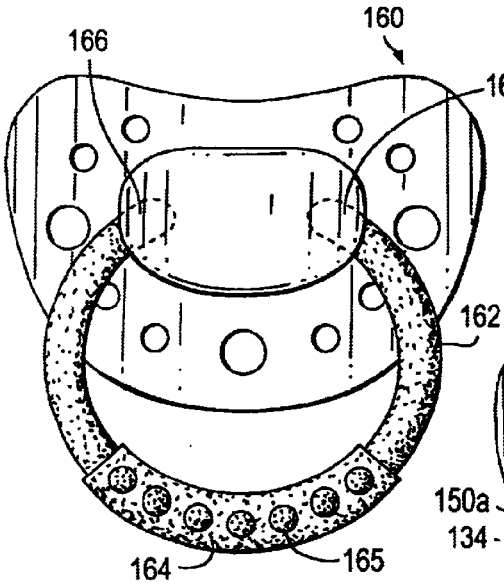
FIG. 14
FIG. 11
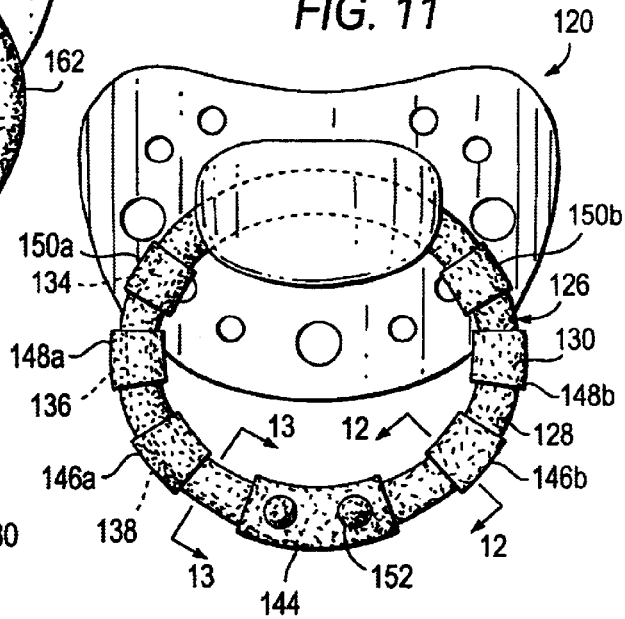
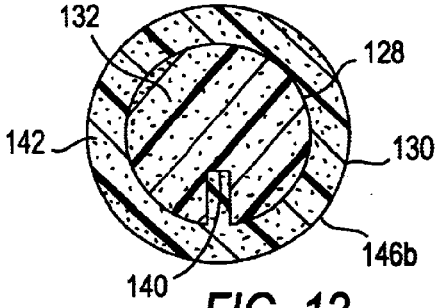
FIG. 12
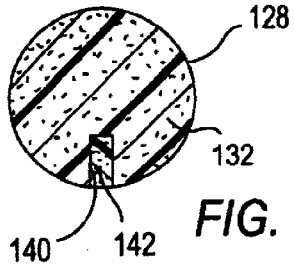
FIG. 13
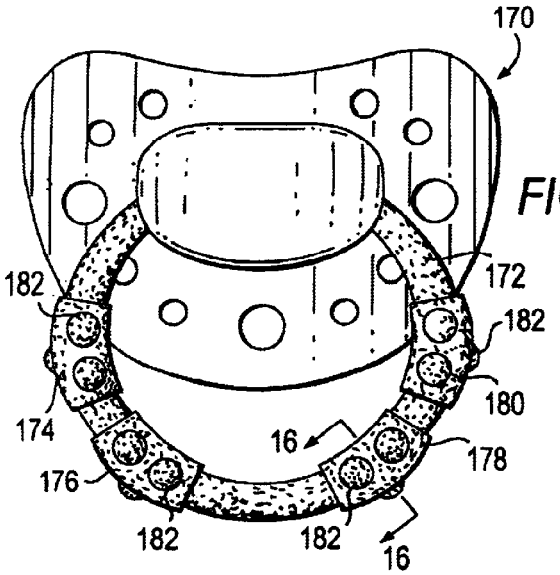
FIG. 15
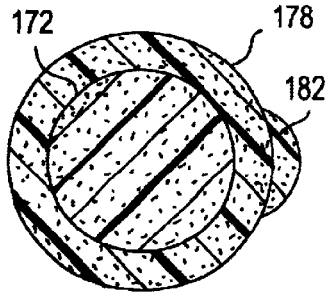
FIG. 16

TEETHING PACIFIER

The present application is a continuation-in-part of Ser. No. 09/620,501, filed Jul. 20, 2000 now U.S. Pat. No. 6,447,536.

BACKGROUND OF THE INVENTION

1. Field of the Invention

The present invention relates in general to pacifiers and, more particularly, to pacifiers which include a teething material associated therewith.

2. Background Art

Pacifiers which incorporate a teething material have been known in the art for many years. In particular, several of these pacifiers have included a teething ring positioned opposite a pacifying nipple to service both the pacifying and teething needs of an infant. Certain of these prior devices have even included contoured teething surfaces on the handle.

For instance, Verschoor, U.S. Pat. No. 3,267,937, discloses a ring pacifier having a nipple, a cap and a ring handle. The ring handle is made of teething material and further includes protuberances which are shaped as small ovals. The oval protuberances are spaced apart from each on both the top and bottom surfaces of the teething ring. Notably, the protuberances are simply raised portions of the teething ring, and consist of the same material as the underlying ring substrate.

Likewise, Colm, U.S. Pat. No. 2,717,603, discloses a teething pacifier having a nipple, a guard and a ring swingably mounted on a hub which extends from the rear side of the pacifier guard. The ring varies in width, having a larger diameter toward the middle and decreasing in diameter toward the split ends which connect into the hub. The ring is constructed of a teething material, and further includes ribs to provide a gum massaging location for an infant. The ribs are spaced apart and concentrated on the wider middle portion of the handle. However, the ribs do not extend around the entirety of the handle and thus leave portions of the teething ring without any contoured teething surface. Further, the ribs are simply extensions of the underlying teething material, not a distinct teething material.

Also somewhat similarly, Herbst, U.S. Pat. No. 3,669,117, describes a combination teether/pacifier device having a nipple, a guard and a teething ring portion. Each side of the teething ring includes inset curved wall portions emanating from the inside of the ring which are designed to contour to an infant's mouth. Each of those insets further includes spaced protuberances to form a roughened teething surface for an infant. Again, like the roughened or contoured surfaces in both Verschoor and Colm, the spaced protuberances are formed from the same material as the underlying ring. Moreover, the selective pattern of teething material is concentrated near the guard, a potentially undesirable location given an infant's propensity to put the entire pacifier into his or her mouth.

Accordingly, it is a goal in the art to provide a pacifier with a pacifying handle or ring which incorporates at least two different teething materials to increase an infant's teething experience, which different teething materials provide an infant with a different and varied teething feel on his or her gums.

It is also desirable to provide two different teething materials in an alternating pattern whereby an infant can access regions of both teething materials.

It is a further goal in the art to provide a pacifier with a teething handle which specifically directs an infants teething activities away from the guard or shield portion of the pacifier. Inasmuch as infants often have a propensity to place the entire guard or shield into their mouth, thus creating potentially dangerous situations, arranging the teething material on the teething handle to focus an infant away from the point where that handle connects with the guard or shield is desirable.

It is yet a further goal in the art to provide teething portions which are specifically textured or contoured to provide an infant with yet additional teething sensation.

These and other desirous characteristics of the present invention will become readily apparent in light of the present specification (including claims) and drawings.

SUMMARY OF THE INVENTION

The present invention is directed to a teething pacifier comprising a pacifier guard having two opposing sides, a nipple and a teething handle. The nipple extends from one side of the pacifier guard, while a connection hub is associated with the opposing side. The teething handle is pivotally connected to the hub, and includes a first teething material having a first hardness, and a second teething material having a hardness substantially similar to that of the first teething material. The handle preferably further includes a proximal portion positioned proximate the pacifier guard and a distal portion positionable away from the pacifier guard.

In one embodiment, the first and second teething materials are substantially hard. In another embodiment, the first and second teething materials are substantially soft.

The second teething material is molded over the first teething material to create a varied teething surface on the handle for infant teething thereon. The second teething material is preferably integrally bonded to first teething material The first teething material may further include at least one recess into which the second teething material is molded. In an embodiment, the recess extends around the substantial entirety of the handle circumference. The second teething material may likewise extend around the substantial entirety of the handle circumference at one or multiple locations on the handle. Also in an embodiment, a portion of the second teething material extends above the surface of the first teething material.

Alternatively to or in addition to the at least one recess, the first teething material may further include other overmold enhancing surfaces to facilitate securing the second teething material to the handle. In one embodiment, the overmold enhancing surface includes a keyway extending around the handle for anchoring the second teething material to the handle. In another embodiment, the overmold enhancing surface includes at least one flat face extending at least partially around the handle.

The second teething material may be molded over the first teething material in at least two distinct regions on the handle to expose at least one region of first teething material. In an embodiment, the handle includes alternating regions of first teething material and second teething material. In another embodiment, at least two of the alternating regions of second teething material are at least partially connected by at least one region of second teething material.

In an embodiment, the second teething material takes the form of bands which expose at least one region of the first teething material. The bands may be spaced apart so as to create alternating regions of first and second teething material. Also in an embodiment, the overmolded bands decrease in width toward the proximal portion of the handle to direct an infant to teethe on the distal end of the handle—away from the pacifier guard. In yet another embodiment, one or more of the bands include a textured teething surface, such as bumps, protuberances, ridges, grooves, or knobs to provide an enhanced teething surface.

BRIEF DESCRIPTION OF THE DRAWINGS

FIG. 1 is a rear perspective view of a teething pacifier according to the present invention;

FIG. 2 is a side elevational view of the teething pacifier shown in FIG. 1;

FIG. 3 is a rear elevational view of the teething pacifier shown in FIG. 1;

FIG. 4 is a top plan view of the teething pacifier shown in FIG. 1;

FIG. 5 is a cross sectional view of the handle of the teething pacifier shown in FIG. 1 taken along the lines 5—5;

FIG. 11 is a rear elevational view of a teething pacifier according to another embodiment of the present invention;

FIG. 12 is a cross-sectional view of the handle of the teething pacifier shown in FIG. 11, taken along the lines 12—12;

FIG. 13 is a cross-sectional view of the handle of the teething pacifier shown in FIG. 11, taken along the lines 13—13;

FIG. 14 is a rear elevational view of a teething pacifier according to another embodiment of the present invention;

FIG. 15 is a rear elevational view of a teething pacifier according to yet another embodiment of the present invention;

FIG. 16 is a cross-sectional view of the handle of the teething pacifier shown in FIG. 15, taken along the lines 16—16;

DETAILED DESCRIPTION OF THE DRAWINGS

Figure 6:
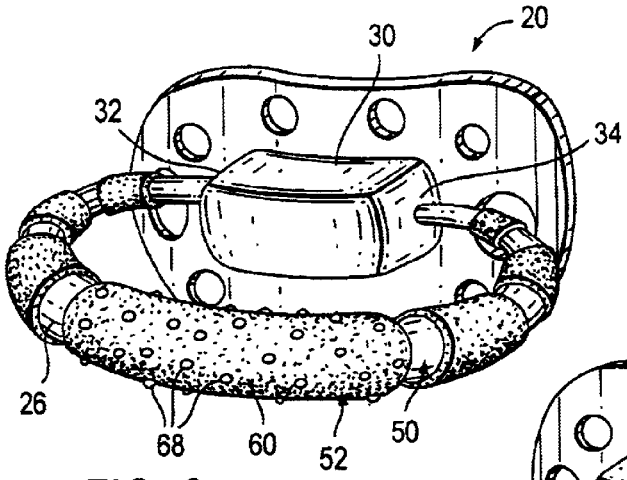
FIG. 6 is a rear perspective view of the teething pacifier shown in FIG. 1 with the handle pivoted upwardly.

While this invention is susceptible of embodiment in many different forms, there are shown in the drawings and will herein be described in detail several specific embodiments with the understanding that the present disclosure is to be considered as an exemplification of the principles of the invention and is not intended to limit the invention to the embodiments illustrated.

Pacifier 20 is shown in FIGS. 1–6 as comprising guard 22, nipple 24 and handle 26. At the outset, it is noted that while the guard and nipple portions of teething pacifier 20 are shown in the drawings as having a specific construction and configuration, it is contemplated that any nipple and/or guard may be used in combination with the present invention—as long as a handle or teething element may be attached to some portion of the guard and/or nipple. Moreover, throughout this description and the drawings, like parts will be designated by like reference numerals.

Guard 22 is shown in FIGS. 1–6 as comprising first side 27, second side 28, apertures 29 and connection hub 30. As is well known in the art, apertures allow air to pass through guard 22 to help aerate the area of an infant's face contacted by guard 22 when an infant is sucking on nipple 24. To this end, apertures 29 make take any form, as well as any shape and dimension, to further this end. Nipple 24 preferably extends from first side 27 of guard 22, while connection hub 30 preferably extends from opposing second side 28 of guard 22.

Connection hub 30 includes first side portion 32 and second side portion 34. Connection hub 30 preferably includes apertures in both first side portion 32 and second side portion 34 to pivotally accept handle 26. Those apertures may extend through the entirety of hub to create one throughway for handle 26, or may extend only partially into the first and second side portions of connection hub 30 as sockets, depending on construction of handle 26. Certainly, those with ordinary skill in the art with the present disclosure before them will recognize that hub may be constructed in any number of ways to allow the handle to be pivotably connected to the connection hub.

Further, while guard 22 is shown in all of the figures, it is contemplated that nipple 24 may be directly connected to connection hub 30, either through guard 22, or without any guard at all. In a scenario where the teething pacifier includes no guard, the connection hub or other handle receiving structure may act as a separation barrier between the nipple and the handle. Further, it is also contemplated that the guard is constructed in such a way as to obviate the need for a connection hub. In particular, the handle may be connected directly to the guard, while preferably maintaining pivotal movement of the handle relative to the guard.

Handle 26 is shown in FIGS. 1–6 as comprising proximal portion 36, distal portion 38, substrate 40 and overmold 42. Proximal portion 36 is positioned proximate connection hub 30, at the point where handle 26 enters into connection hub. Proximal portion 36 includes first proximal portion 44 positioned proximate first side portion 32 of connection hub 30, and second proximal portion 46 positioned proximate second side portion 34 of connection hub 30. Notably, handle 26 may be constructed as a complete ring which extends entirely through connection hub 30, or, in the alternative, as a C-shaped piece with two distinct ends. With a C-shaped handle construction having two ends, connection hub 30 may include sockets in both first side portion 32 and second side portion 34 to receive the free ends of the handle. However, in any handle construction, and is shown in comparing FIGS. 1 and 6, handle 26 is preferably pivotal relative to connection hub 30 and guard 22 to provide for teething on the handle in multiple handle orientations.

Distal portion 38 of handle 26 is positioned opposite connection hub 30, and is preferably a portion of handle 26 which remains most remote from guard 22. As can be seen from examining FIGS. 1–4 and 6, distal portion 38 of handle 26 preferably includes a larger diameter than proximal portion 36. The larger diameter of distal portion 38 provides a larger teething surface for an infant, thus helping to direct an infant to teethe on distal portion 38 of handle 26. Additionally, a varying handle diameter also provides an infant with additional shape and contour options in the teething process. However, it is certainly contemplated that handle 26 may be of a uniform diameter. It must also be noted that while handle 26 is shown taking a substantially ring or C-shaped configuration, handle 26 may likewise comprise a square, rectangle, or any other shape as would be contemplated by those with ordinary skill in the art. Further, while handle is shown as having a substantially round cross section, such as that shown in FIG. 5, that cross section may comprise any number of shapes or surface contours, depending on specific teething application.

Substrate 40, shown in FIGS. 1–5, preferably comprises first teething material 50. In the teething pacifier shown in FIGS. 1–6, first teething material 50 preferably comprises a rigid material, such as ABS, polycarbonate or polypropoleyne. Those with ordinary skill in the art will recognize that such a hard, rigid material functions as a desirable teething surface for infants. Further, as touched upon above, substrate 40 may vary in diameter to provide varying surface areas of teething material progressing from distal portion 38 of handle 26 to proximal portion 36 of the handle.

Overmold 42, also shown in FIGS. 1–6, preferably comprises second teething material 52. In contrast to the harder, rigid first teething material 50, second teething material 52 is preferably formed from a softer material, such as dynaflex. Second teething material 52 provides a teething variation from first teething material 50, allowing an infant to teethe on either or both of first teething material 50 and second teething material 52, depending on infant preference, stage of tooth development, etc.

Second teething material 52 preferably comprises a series of bands 60, 62*a* and *b*, 64*a* and *b*, and 66*a* and *b* molded over first teething material 50. The bands preferably wrap around the entirety of substrate 40, so that an infant may contact any given band independent of the pivotable position of handle 26, and independent of the position of handle 26 in an infant's mouth. As can be seen from FIGS. 1–6, bands 60, 62*a* and *b*, 64*a* and *b*, and 66*a* and *b* preferably decrease in width as they approach connection hub 30. In particular, band 60 is preferably the widest, and is positioned on the distal-most portion 38 of handle 26. Concentrating the wider bands on distal portion 38 of handle 26 provides a larger concentration of the desirable second teething material 52 in those locations, thus directing an infant to the distal portion of the handle. This is advantageous in the teething pacifier context as an infant is directed away from guard 22, and directly to the teething handle 26—thus minimizing the chance that an infant will place the entire guard into his or her mouth, a common and undesirable occurrence in the infant teething-pacifying context.

Of course, it is likewise contemplated that the bands need not all narrow in width as they approach connection hub 30. Likewise, opposing bands, such as bands 62*a* and 62*b*, or bands 64*a* and 64*b*, need not have the same width. Further, it may be desired to place more distance between the different bands of second teething material 52 to expose larger regions of first teething material 50. This will provide an infant with larger teething regions of first teething material 50.

Second teething material 52 may further include textured teething surface 68, shown in FIGS. 1–6. While textured teething surface 68 is shown in the drawings as comprising a series of bumps, protuberances or knobs, it is likewise contemplated that the textured teething surface may comprise any variation in surface continuity, such as ridges, depressions, or rings. Textured teething surface 68 provides an infant with yet another variation in the teething surface to further enhance the teething process. Furthermore, placement of textured teething surface 68 on band 60 additionally acts to direct an infant to distal portion 38 of handle 26, and away from proximal portion 36 of handle 26 near guard 22—yet another mechanism to keep an infant from placing guard 22 into his or her mouth. Of course, while textured teething surface 68 is shown only on band 60, it is likewise contemplated that the textured teething surface may be placed on any or all of the other bands. Further, while not shown in the drawings, such a textured teething surface may also be placed on first teething material 50 as well.

Additionally, while not specifically shown in FIGS. 1–6, second teething material 52 may also vary in thickness. In particular, while second teething material 52 is shown as having a substantially uniform thickness in FIGS. 1–6, it is contemplated that those bands may vary in thickness to provide additional raised areas on handle 26. Indeed, those raised areas provide yet additional teething variations for an infant, and may further focus an infant to a specific portion of handle. It is also contemplated, though also not shown in the drawings, to include additional teething materials beyond the first and second teething materials.

Figure 7:
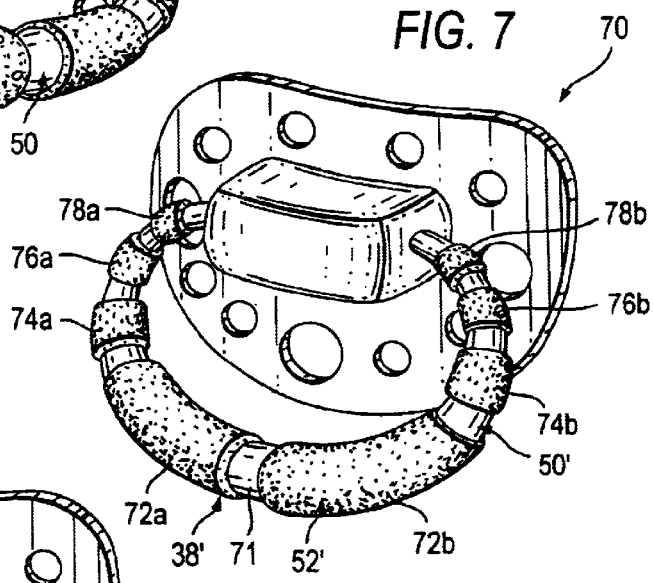
FIG. 7 is a rear perspective view of a teething pacifier according to another embodiment of the present invention.

Of course, the specific pattern of second teething material 52 in FIGS. 1–6 is just an example of the many different patterns in which a teething material may be overmolded onto another teething material. For instance, teething pacifier 70 is shown in FIG. 7 as including handle 71 with first teething material 50' and second teething material 52'. However, instead of the configuration of second teething material 52 in FIGS. 1–6, second teething material 52' include bands 72*a* and 72*b*, 74*a* and *b*, 76*a* and 72*b* and 78*a* and *b*. Thus, two wider bands 72*a* and 72*b* are positioned on distal portion 38' of handle 71, thus leaving a region of first teething material 50' exposed at a point directly opposite the connection hub.

Figure 8:
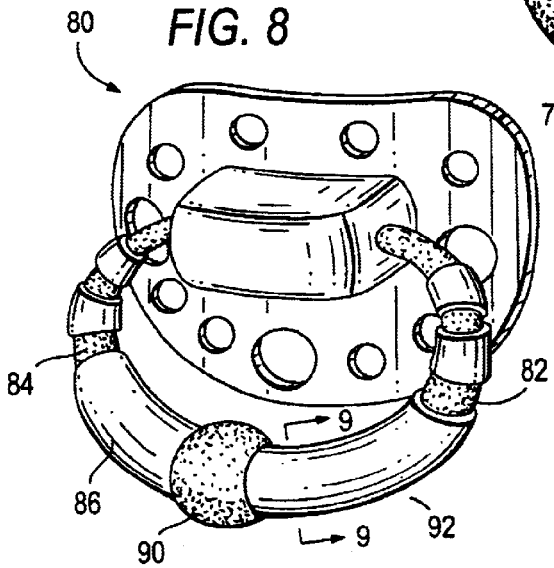
FIG. 8 is a rear perspective view of a teething pacifier according to yet another embodiment of the present invention.
Figure 9:
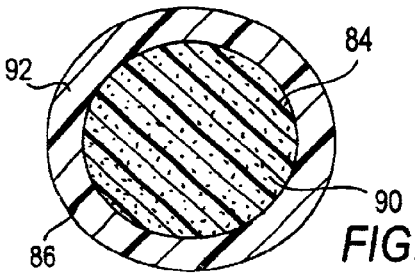
FIG. 9 is a cross sectional view of the handle of the teething pacifier shown in FIG. 8 taken along the lines 9—9.

In another embodiment, teething pacifier 80 is shown in FIGS. 8 and 9 as including substantially the same guard, nipple and connection hub components, but as including a different handle 82 wherein the first and second teething materials are reversed. In particular, handle 82 comprises substrate 84 and overmold 86. In contrast to substrate 40 of FIGS. 1–6 which comprised first teething material 50, substrate 84 preferably comprises second teething material 90. Similarly, instead of an overmold constructed from second teething material 52, overmold 86 comprises first teething material 92. Like the first and second teething materials described above, second teething material 90 preferably is a softer material such as dynaflex, while overmold first teething material 92 preferably comprises a more rigid material such as ABS, polycarbonate or polypropylene. Forming substrate 84 from second teething material 90 may further increase flexibility of handle 82. This may be advantageous for both infants and parents, as infants are teething on a less rigid handle which has more flexibility and give.

As can be seen from FIG. 8, the bands of first teething material 92, like the bands of second teething material shown in FIG. 7, are preferably wider towards the distal end of handle 82, and become narrower towards the proximal end of the handle—to direct an infant to the distal end of the handle for teething. However, as was discussed above in conjunction with FIGS. 1–7, it is likewise contemplated that any number of different band widths, thicknesses or patterns on substrate 84 may be used, as would be known by those with ordinary skill in the art with the present disclosure before them. Moreover, though not shown in FIGS. 8 and 9, both second teething material 90 and first teething material 92 may further include a textured teething surface, such as textured teething surface 68 shown in FIGS. 1–6.

Notably, overmolding a harder, more rigid first teething material 92 onto a softer, more compressive second teething material 90 may result in substrate bulging, such as that shown in FIG. 8. The bulging is caused by the inherent compressibility of second teething material 90, and may provide additional texture and/or handle thickness to provide even further teething variances for an infant. Of course, the extent of bulging depends on a number of factors, including the nature of the first and second teething materials, the width of the overmold bands, the outer diameter of the overmold bands, etc. These factors may be manipulated to provide a desirable amount of bulging or no bulging at all, depending on design preferences and teething requirements. Additionally, the overmold may include a combination of first and second teething materials, to provide further teething variations.

It is also contemplated that the handle may comprise a three layer structure, instead of the two layer structure shown in FIGS. 8 and 9. In particular, the handle may comprise an underlying substrate, which is coated by the second teething material, which is then overmolded with the first teething material. Such a construction may provide increased rigidity of the handle, if so desired.

Figure 10:
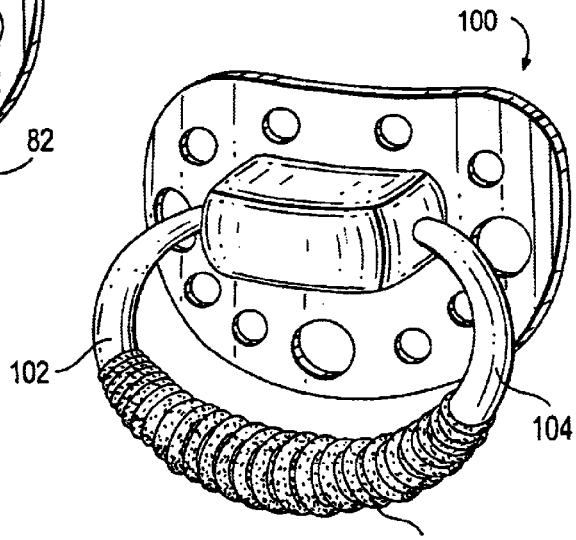
FIG. 10 is a rear perspective view of a teething pacifier according to another embodiment of the present invention.

Of course, the wider bands shown in FIGS. 1–8 are not the only overmold construction. For instance, and as shown in FIG. 10, teething pacifier 100 includes handle 102, which includes substrate 104 and overmold 106. As can be seen from FIG. 10, instead of wider bands, overmold 106 comprises narrower rings placed in relatively close succession over substrate 104. Further, the rings are preferably positioned on the distal portion of the handle, away from the connection hub and guard, to direct an infant to the distal portion of the handle. Further, the rings are shown as having a larger diameter towards the most distal point on the handle, with the rings becoming both narrower and of a lesser diameter as they approach the proximal ends of the handle and the connection hub. Such an overmold configuration provides yet another teething pattern for an infant. Of course, the space between the rings may be increased to expose larger regions of the substrate, as would be known by those of ordinary skill in the art with the present disclosure before them. Additionally, the rings may remain moveable on the substrate to allow adjustment of the distance between the rings, the size of the regions of substrate exposed by the rings, the grouping or concentration of the rings, etc. Such a construction allows a parent to create, in essence, their own teething pattern.

Further, substrate 104 may comprise either the first teething material, such as the substrate configuration shown and described in reference to FIGS. 1–7, or the second teething material, such as the substrate configuration shown and described in reference to FIGS. 8–9. Likewise, overmold 106 may comprise either the first or the second teething material, depending on the composition of substrate 104. Additionally, it is contemplated that such a ring type of configuration may be placed over the overmold bands which are shown and described in FIGS. 1–9, to provide yet further texture and to teething material variation. Of course, those of ordinary skill in the art with the present disclosure before them will recognize that any number of different first and second teething materials configurations are possible to expose at least one region of both the first and second teething materials—whether those regions of first and second teething material are alternating, or whether the handle is simply divided into two halves, one half including the first teething material and the second half including a second teething material.

In another embodiment, shown in FIGS. 11–13, teething pacifier 120 includes substantially the same guard, connection hub and nipple components, but a different handle. In particular, handle 126 comprises substrate 128 and overmold 130. Substrate 128 is formed from first teething material 132, while overmold 130 is formed from second teething material 142. First teething material 132 is preferably a material which is substantially similar to second teething material 142. Specifically, it is preferred that the first and second teething materials have a similar hardness. Thus, it is contemplated that both first and second teething materials may be selected from a more rigid material, such as ABS, polycarbonate or polypropoleyne, which functions as a desirable teething surface for infants. However, it is also contemplated that the first and second teething materials may be selected from a softer material, such as dynaflex. Likewise, other materials having a different hardness are contemplated for use with the present invention, provided that the second teething material may be overmolded, or molded over the first teething material.

First teething material 132, shown in FIG. 11, includes recessed regions 134, 136 and 138 and channel 140. Recessed regions 134, 136 and 138 are formed into substrate 128, and preferably extend around the circumference of handle 126 at selected points to provide molding regions for overmolding second teething material 142 onto first teething material 132. In particular, the diameter of substrate 128 in the areas of the recessed regions is preferably less than the diameter of the substrate between those recessed regions. Moreover, as can be seen from FIG. 11, the recessed regions are preferably of a width or span which substantially matches the width or span of second teething material bands 144, 146*a* and *b*, 148*a* and *b*, and 150*a* and *b*. Notably, while shown as associated with only three of the bands of second teething material in FIG. 11, recessed regions preferably exist in conjunction with each band of second teething material. Aside from facilitating the overmolding of second teething material 142, recessed regions 134, 136 and 138 likewise provide a more secure, integral relationship between the first and second teething materials.

Channel 140, shown in FIGS. 12 and 13, likewise serves to facilitate overmolding of second teething material 142 onto first teething material 132, while also enhancing the molded connection between the bands of second teething material and the first teething material substrate. In particular, second teething material 142 extends into channel 140 in first teething material 132 to anchor the bands of second teething material onto first teething material 132 and substrate 128. Channel 140 may extend all the way around the entirety of the ring, or in the alternative, may span just the width of the bands of second teething material.

As shown in FIG. 11, second teething material 142 further includes textured teething surface 152. Textured teething surface 152 provides an infant with additional contour to enhance the teething experience.

In another embodiment, shown in FIG. 14, teething pacifier 160 is shown as including a larger, single region of second teething material 164 molded over substrate 162. Second teething material 164 may further include textured teething surface 165, to enhance the teething experience.

Moreover, as discussed above, second teething material 164 is preferably positioned on the distal end of the teething ring to direct an infant away from the guard portion of the pacifier, which guard portion may be dangerous if placed in an infant's mouth. Additionally, the teething handle is shown as having two ends 166 and 168 that fit into sockets in the connection hub. Of course, in any of the embodiments shown or described, the handle may have a two-end configuration, or the handle may comprise a single, unitary piece, such as that shown in FIG. 11.

In another alternative embodiment, shown in FIGS. 15 and 16, teething pacifier 170 includes substrate 172, preferably made from a first teething material, and bands of a second teething material 174, 176, 178 and 180 molded over substrate 172. Like the embodiments shown in FIGS. 11–13 and FIG. 14, the first and second teething materials preferably have a similar hardness, but may also be formed from differing teething materials. Moreover, the bands of second teething material may each further include textured teething surfaces 182, shown as taking the form of bumps or protuberances extending outward from the different sides of the bands of the second teething material. However, in contrast to the embodiments shown in FIGS. 11–14, the bands of second teething material shown in FIGS. 15 and 16 is molded directly over the first teething material substrate 172, without the any additional recessed regions or channels. Preferably, the overmolding forms an integral bond between the first and second teething materials, as would be know by those with ordinary skill in the art with the present disclosure before them.

Figure 17:
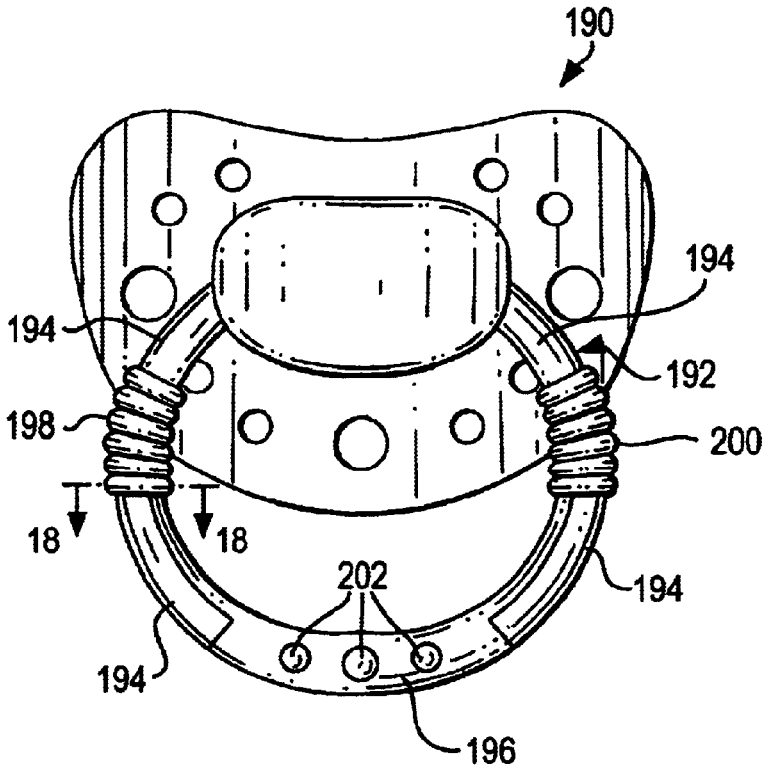
FIG. 17 is a rear elevational view of a teething pacifier according to still another embodiment of the present invention.
Figure 18:
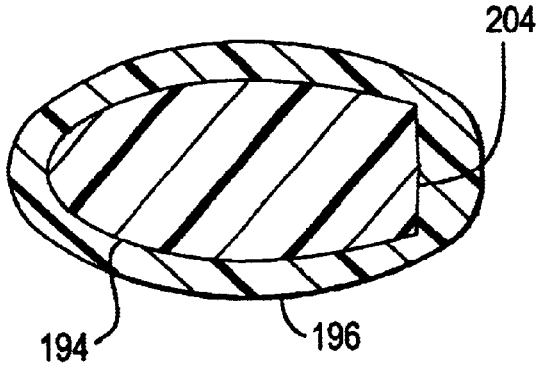
FIG. 18 is a cross-sectional view of the handle of a teething pacifier shown in FIG. 17, taken along the lines 18—18.

In another alternative embodiment, shown in FIGS. 17 and 18, teething pacifier 190 includes a handle 192 formed from first teething material 194 and second teething material 196. First teething 194 preferably forms the handle substrate, while second teething material 196 is overmolded onto first teething material 194. In particular, as shown in FIG. 17, second teething material 196 includes bands 198, bands 200 and teething protruberances 202. Bands 198 and 200 are preferably textured or ribbed, as shown in FIG. 17. Although bands 198 and 200 may have a uniform texture, the bands may include any number of other different contours and textures, as would be known by those with ordinary skill in the art with the present disclosure before them. Moreover, while bands 198 and 200 are formed on opposing sides of handle 192, second teething material bands 198 and 200 may be formed at any point on handle 192.

Teething protruberances 202 are shown as formed as three circular shaped mounds on the distal portion of handle 192. Preferably, teething protruberances 202 are formed on both the top and bottom portions of handle 192. However, it is likewise contemplated that the teething protuberances may take any shape, may be placed at any location on the handle, and may take any desired number. However, it must be noted that it is desirable to have some contoured teething surface on the distal portion of the handle to provide an infant with a teething option away from the pacifier guard.

As can further be seen from FIGS. 17 and 18, while handle 192 is shown as substantially oval, first teething material 194 preferably includes an overmold enhancing surface, namely substantially flat face 204 spanning at least a portion of handle 192. Flat face 204 facilitates molding second teething material 196 onto first teething material 194, and provides an enhanced securement between the first and second teething materials. Moreover, as can be seen from FIG. 17, second teething material 196 may be molded over first teething material 194 in various regions without necessarily creating a differing contour. This may be done to facilitate the molding process for those regions which vary in contour, or to provide a second teething material having differing properties, such as color or material.

Further, like the teething pacifier described in FIGS. 11–16, first and second teething materials 194 and 196 are preferably the same or similar materials, so as to possess substantially similar hardnesses. However, as has been described with respect to FIGS. 11–16, it is also contemplated that the first and second teething materials may be formed from other similar materials, or, in the alternative, from differing materials. Moreover, it is likewise contemplated that first teething material 194, and more particularly, handle 192, may be altered in any number of ways as would be known by those of ordinary skill in the art to enhance either the molding process, or the integral connection between the first and second teething materials. For instance, both sides of first teething material substrate may be flattened. Likewise, a channel, such as that shown in FIGS. 12 and 13, may be formed into the first teething material substrate. Further, recessed regions, such as those shown in FIG. 11, may be formed into handle 192 proximate bands 198 and 200. Of course, handle 192 may take not only an oval or circular shape, but also other non-circular or non-uniform shapes as would be desirable in the teething context.

The foregoing description and drawings merely explain and illustrate the invention, the invention is not limited thereto except insofar as the appended claims are so limited as those skilled in the art having the present disclosure before will be able to make modifications and variations therein without departing from the scope of the invention.

What is claimed is:

1. A teething pacifier comprising:

a pacifier guard having at least a first side and a second side opposite said first side;

a nipple extending outwardly from said first side of said pacifier guard;

a handle associated with said second side of said pacifier guard, said handle including at least one proximal portion positioned proximate said pacifier guard and a distal portion positionable away from said pacifier guard;

said handle comprising a first teething material that is substantially hard and a second teething material having a hardness substantially similar to that of said first hardness of said first teething material, said second teething material molded over said first teething material to create a varied teething surface on said handle for infant teething thereon.

2. The teething pacifier according to claim 1 wherein each of said first and second teething materials are substantially hard.

3. The teething pacifier according to claim 1 wherein each of said first and second teething materials are substantially soft.

4. The teething pacifier according to claim 1 wherein said second teething material is integrally bonded to said first teething material.

5. The teething pacifier according to claim 1 wherein said first teething material of said handle further includes at least one recess into which said second teething material is molded.

6. The teething pacifier according to claim 5 wherein at least a portion of said second teething material extends above the surface of said first teething material.

7. The teething pacifier according to claim 5 wherein at least a longitudinal portion of said handle further includes a continuous circumference, and wherein said at least one recess extends around the substantial entirety of the handle circumference such that said second teething material extends around the substantial entirety of the circumference of said handle at one or more locations on said handle.

8. The teething pacifier according to claim 1 wherein said first teething material further includes at least one overmold enhancing surface to facilitate securing said second teething material to said handle.

9. The teething pacifier according to claim 8 wherein said overmold enhancing surface comprises a keyway for anchoring said second teething material to said handle.

10. The teething pacifier according to claim 9 wherein said keyway extends around the substantial entirety of said handle.

11. The teething pacifier according to claim 8 wherein said overmold enhancing surface comprises at least one flat face extending at least partially around said handle.

12. The teething pacifier according to claim 8 wherein said overmold enhancing surface comprises at least one recess into which said second teething material is molded.

13. The teething pacifier according to claim 1 wherein said second teething material is molded over said first teething material in at least two distinct regions on said handle to expose at least one region of first teething material.

14. The teething pacifier according to claim 13 wherein said handle includes alternating regions of first teething material and second teething material.

15. The teething pacifier according to claim 13 wherein at least two of said regions of second teething material are at least partially connected by at least one region of second teething material.

16. The teething pacifier according to claim 1 wherein at least a longitudinal portion of said handle further includes a continuous circumference, and wherein said second teething material extends around the substantial entirety of the continuous circumference of said handle at one or more locations on said handle.

17. The teething pacifier according to claim 1 wherein said second teething material comprises a plurality of bands spaced apart from one another to expose at least one region of first teething material.

18. The teething pacifier according to claim 17 wherein said plurality of bands of second teething material each include a width, and wherein the width of at least one of said bands is greater than the width of at least one other band to direct infant teething to a desired location on said handle.

19. The teething pacifier according to claim 1 wherein said second teething material further includes a textured teething surface.

20. A method of forming a teething pacifier having a pacifier guard, a nipple extending outwardly from one side of the pacifier guard, and a handle associated with another side of the pacifier guard, said method comprising the steps of:

forming at least a portion of said handle from a first teething material having a first hardness, molding a second teething material having a hardness substantially similar to that of said first hardness of said first teething material over at least a portion of said first teething material to create a varied teething surface on said handle for infant teething thereon.

21. The method according to claim 20 wherein the step of molding the second teething material over at least a portion of the first teething material includes the integral bonding of said second teething material to said first teething material.

22. The method according to claim 20 wherein at least a longitudinal portion of said handle further includes a continuous circumference, and wherein the step of molding the second teething material over at least a portion of the first teething material includes molding the second teething material around the substantial entirety of the circumference of said handle at one or more locations on said handle.

23. The method according to claim 20 wherein the step of forming at least a portion of said handle from the first teething material further includes the step of forming at least one keyway in said first teething material, and further includes molding said second teething material into said at least one keyway to facilitate securing of said second material relative to said first teething material.

24. The method according to claim 20 wherein the step of forming at least a portion of said handle from the first teething material further includes the step of forming at least one flat face extending at least partially around said handle, and molding said second teething material onto said at least one flat face to facilitate securing of said second teething material relative to said first teething material.

* * * * *